US005483904A

United States Patent [19]

Kelly et al.

[11] Patent Number: 5,483,904

[45] Date of Patent: Jan. 16, 1996

[54] LIGHT WEIGHT TABLE STRUCTURES

[75] Inventors: Ray G. Kelly; Sharon A. Turnbough, both of St Louis, Mo.; Diane Taraskavage, San Diego, Calif.; Douglas L. Blocker, Jefferson, Mo.

[73] Assignee: Angeles Group, Inc., Pacific, Mo.

[21] Appl. No.: 243,310

[22] Filed: May 16, 1994

[51] Int. Cl.[6] ..... A47B 3/06

[52] U.S. Cl. ..... 108/156; 108/158

[58] Field of Search ..... 108/165, 180, 108/186, 192, 156, 158, 153, 901, 51.3

[56] References Cited

U.S. PATENT DOCUMENTS

| | | | |
|---|---|---|---|
| 2,646,327 | 7/1953 | Saaf | 108/158 X |
| 2,851,322 | 9/1958 | Molla | 108/156 |
| 2,901,301 | 8/1959 | Johnson | 108/156 |
| 3,291,079 | 12/1966 | Ruda | 108/156 |
| 4,574,709 | 3/1986 | Lackey et al. | 108/156 X |
| 4,813,201 | 3/1989 | Parsons et al. | 108/156 X |

FOREIGN PATENT DOCUMENTS

| | | | |
|---|---|---|---|
| 1128486 | 1/1957 | France | 108/180 |
| 1332655 | 6/1963 | France | 108/156 |
| 2596965 | 10/1987 | France | 108/153 |
| 4141107 | 5/1992 | Japan | 108/158 |
| 815722 | 7/1959 | United Kingdom | 108/153 |
| 959185 | 5/1964 | United Kingdom | 108/51.1 |
| 1218352 | 1/1971 | United Kingdom | 108/156 |
| 1525435 | 9/1978 | United Kingdom | 108/51.3 |
| 2035069 | 6/1980 | United Kingdom | 108/153 |
| 9101417 | 2/1991 | WIPO | 108/153 |

*Primary Examiner*—Laurie K. Cranmer
*Assistant Examiner*—Janet M. Wilkens
*Attorney, Agent, or Firm*—Paul M. Denk

[57] ABSTRACT

A table includes a table top made of a light weight core covered with a washable coating or liner. The liner extends beyond the edges of the core to define a channel which receives finishing pieces which provide the table edge with a curved surface. A metal framework is received in channels in the bottom of the table surface. Leg receiving bosses are fixed to the framework. The table's legs are threadably secured to the table top via the bosses. This provides a table which is light weight and which may be shipped flat.

16 Claims, 7 Drawing Sheets

LIGHT WEIGHT TABLE STRUCTURES

BACKGROUND OF THE INVENTION

This invention relates to furniture for use in nurseries, kindergarten classrooms and the like, and in particular to tables for use in such rooms.

Tables have long been used in nurseries, kindergarten classrooms, and the like. In this environment, it is desirable that the tables be easily cleaned, that it can support the weight of a small child, and that no sharp corners be present. It is also important that the furniture be light weight, so that it may be easily moved if necessary. In addition, it is further desirable to provide a cushioning type means around the perimeter of the table surface, and in this particular instance, comprises a continuous molding that is sufficiently resilient such that when it is encountered, it has some give, in order to prevent any injury to the infant, particularly when such tables are used within a nursery setting.

Further, for purposes of shipping, it is desirable that the storage unit can be sold in an unassembled state, and then be easily assembled on site.

SUMMARY OF THE INVENTION

One object of the present invention is to provide tables for use in nurseries, kindergarten rooms, etc.

Another object is the provision of such tables which are made of light weight material.

Another object is the provision of such tables which are strong and sturdy.

Another object is the provision of such tables which are easily cleaned.

Another object is the provision of such tables which may be easily assembled, preferably without the use of tools.

Another object is the provision of such tables which are economical and simple to produce.

A further object of this invention is to provide a table top having a peripherial edge formed of cushioning material continously around its perimeter.

These and other objects will become apparent to those skilled in the art in light of the following disclosure and accompanying drawings.

Briefly stated, a table of the present invention includes a table top made from a core covered with a coating or liner. The liner extends beyond the edges of the core to define a channel. A finishing piece is received in said channel to give the table a curved edge surface. A channel is formed in the table top lower surface to receive reinforcing members. The reinforcing members join together to define corners. Internally threaded bosses are secured to the reinforcing members at the corners to receive the tables legs. The legs have externally threaded upper portions which are threadably received in the bosses.

The table core or medium is preferably made of corrugated paperboard, honey-combed paperboard, expanded foam, or expanded resin. These are light weight materials and are used to keep the table from getting too heavy. This will allow the table to be moved with ease when necessary.

The finishing pieces include an elongate member having a foot section having a series of legs which are received in the edge channel and a head section extending outwardly from said channel. The head section defines the generally curved surface of the table's edge. If the table has rounded edges, such as a round table or an arcuate table, a single finishing piece is used. This finishing piece is preferably flexible so that a single piece may be used to circumscribe the entire table, and also has inherent resiliency to provide a cushioning effect around the table perimeter.

If the table is polygonal, two finishing pieces are used. A straight finishing piece is applied to the edges. The straight or elongate member includes a wall separating the head section from said foot section and a web extending between ends of the finishing member legs to define a generally hollow member. This makes the finishing member more rigid. The second piece is a curved piece which fits around the table's corners. This corner member includes head section and legs which are received in the channel. The head section is generally arcuate to form the outer edge of the table. Preferably, the curved and straight finishing members interfit with each other. The curved finishing member has a lip at an end of its legs which is received in the straight finishing piece.

The table's legs are made of hollow metal or hard polymer tubes. The use of hollow tubes provides for a sturdy table which is light of weight. A foot piece is received in the bottom of the leg. The foot has a rounded ground engaging portion and an annular lip which is received within said leg. The leg is also provided with a coating which encloses the leg's foot and at least a lower portion of leg. A further purpose of the rounded ground engaging portion at the bottom of each foot, of a table leg, is to provide cushioning in the resting of the table upon the floor or ground, and likewise, prevents the generation of any rust rings, which can frequently occur, where metal legs are used upon tables of this type, and because of frequent mopping of the floor surface by the maintenance service, eventually provides the formation of rust rings, due to the repeat wetting of the bottom of the metal table legs. This is avoided through the use of the ground engaging portions of this invention, which are generally formed of polymer, and eliminates this predicament.

BRIEF DESCRIPTION OF THE DRAWINGS

Corresponding reference numeral refer to similar parts throughout the various drawings.

DESCRIPTION OF THE PREFERRED EMBODIMENT

Figure 4A:
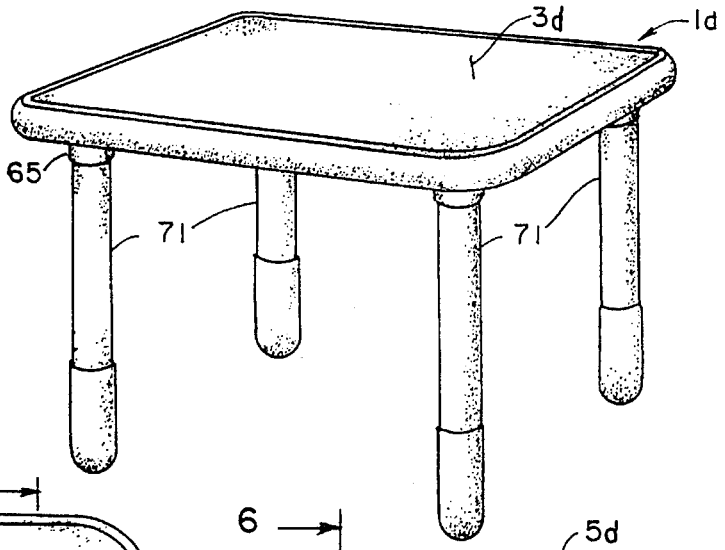
FIGS. 4A–4D are perspective, top plan, elevational, and bottom plan views, respectively, of a square table incorporating the present invention.
Figure 4B:
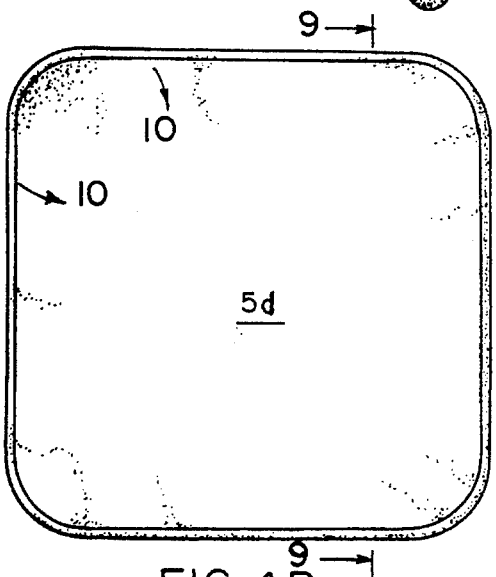
Figure 4C:
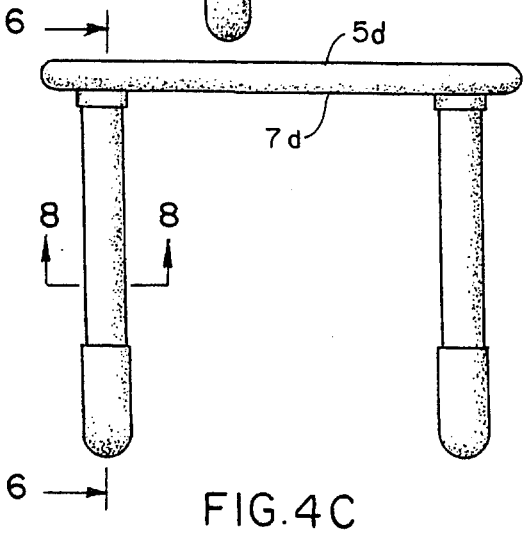
Figure 4D:
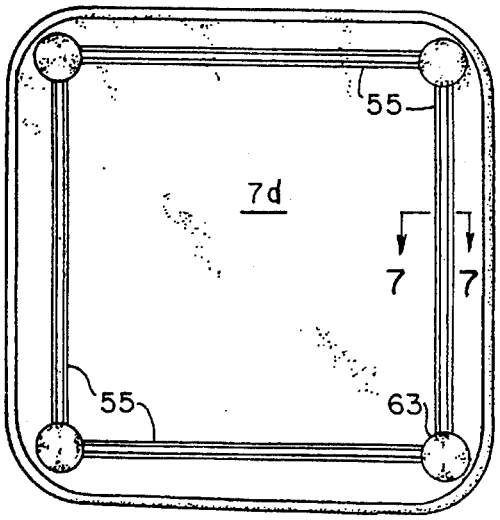
Figure 4E:
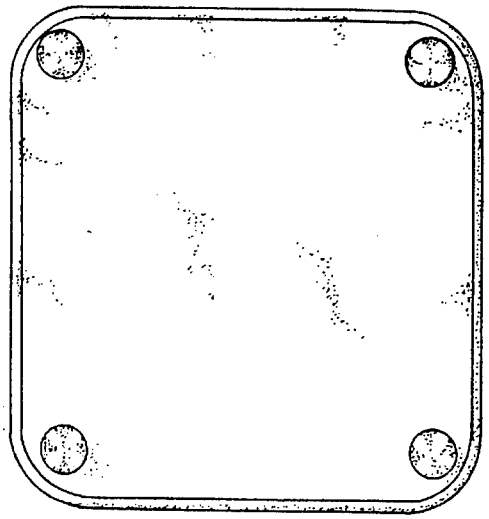
FIG. 4E shows an alternate construction of the square table, shown from its underside.
Figure 5:
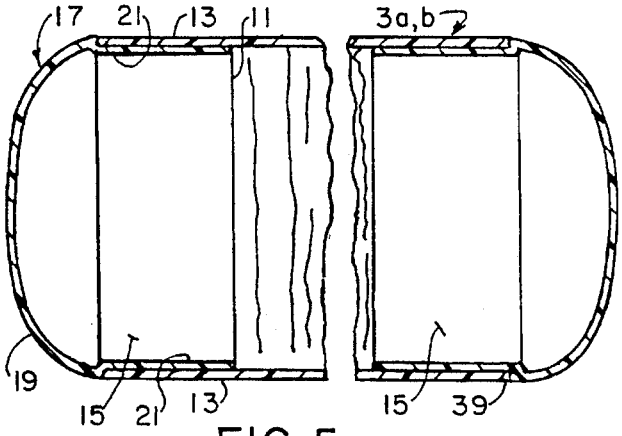
FIG 5 is a cross-sectional view taken along line 5—5 of FIGS. 1C and 2B.
Figure 9:
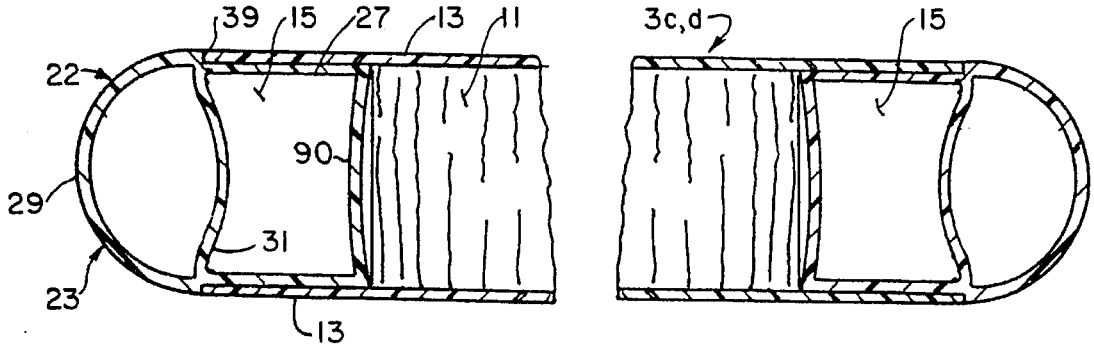
FIG. 9 is a cross-sectional view taken along line 9—9 of FIGS. 3C and 4B.
Figure 10:
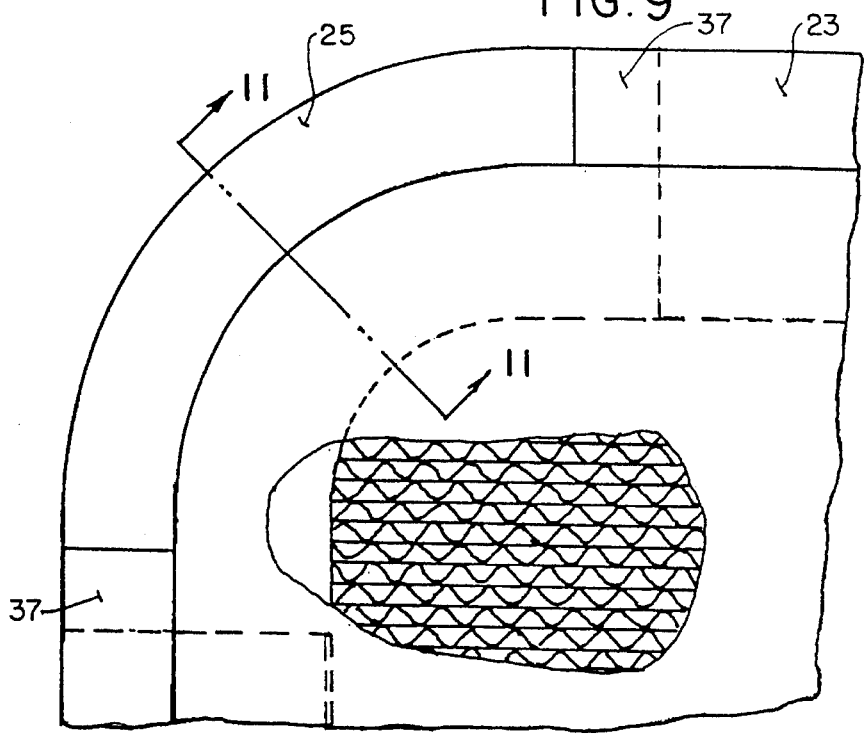
FIG. 10 is a cross-sectional view taken along the line 10—10 of FIG. 4B.
Figure 11:
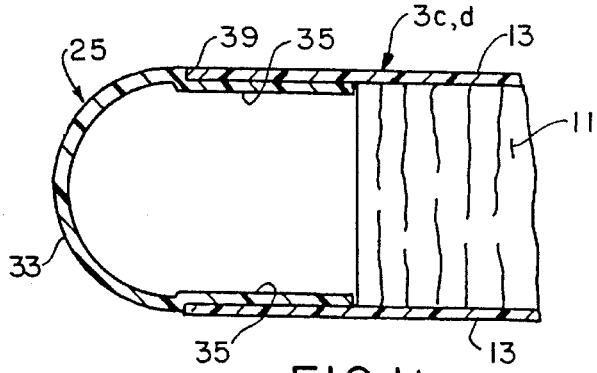
FIG. 11 is a cross-sectional view taking along line 11—11 of FIG. 10.

Turning to FIGS. 1–4, various tables 1*a–d* are shown. Table 1*a* is arcuate; table 1*b* is round; table 1*c* is rectangular, and table 1*d* is square. Tables 1*a–d* each include a table top 3*a–d* having a top surface 5*a–d* and a bottom surface 7*a–d*. As shown in FIGS. 5 and 9, table tops 3*a–d* each include a core or medium 11 made of a light weight material such as corrugated or honey-combed paperboard which may be resin treated to add further stiffness to the core. Other light weight materials, such as styrofoam or foamed resins, may also be used to form the core. The core 11 is covered on its top and bottom (or inner and outer) surfaces by a liner or coating 13 which extends beyond the forward edges of the core to define a channel 15. Liner 13 is preferably formica, or similar coating which may be easily washed and may be formed in many colors.

Turning to FIG. 5, a flexible extruded plastic peripheral finishing piece 17 is received in the table top edge channel 15 of the tables 1*a,b*. Finishing piece 17 has a rounded or curved head section 19 with legs 21 which are received in channels 15. The rounded head 19 is exposed and is provided so that the units have no sharp edges which could potentially injure children. Because the finishing piece 17 is flexible, the extruded plastic finishing piece can be cut to a length equal to the perimeter of the table. This single piece can then be introduced into the table top channel. The configuration of this finishing piece 17 can also be used in short sections for holding the ends of the peripheral finishing piece together.

Turning to FIG. 9, a peripheral finishing piece 22 for the rectangular tables includes an elongate member 23 which extends along the sides of tables 1*c* and 1*d* and a curved member 25 which is received at the corners of the tables. Finishing member 23 has a generally rectangular base portion 27 which is received in channel 15 and a rounded head portion 29 which is exposed. The head and base portions 29 and 27 are separated by a wall 31. Wall 31 adds structural integrity to the piece 23. There also may be a web 90 extending between the ends of the finishing piece's legs to define a generally hollow member. The fit of portion 23 is channel 15 is very snug and is maintained in the slot by friction. This piece is formed of resilient polymer or the like, to add cushioning to the perimeter of these tables at their edges.

Corner piece 25 (FIG. 9) is fitted into tables 1*a–b*, where required, and includes a rounded head section 33 and legs 35 which are received in the table channel. A lip 37 is formed at the ends of the members 25 and extends outwardly therefrom. Lip 37 is formed along the the outer surface of the corner piece and is received in the peripheral finishing piece 23 to provide an area of joinder between pieces 23 and corner pieces 25. These corner pieces 25 are formed of more rigid polymer.

All the finishing pieces define a small shoulder 39 at the base of their respective head sections. Shoulder 39 receive the liners 13 of core 11 so that the outer edge of the finishing members are flush with the outer surfaces of the table. This will give the table a smooth surface without any interruptions or sharp edges.

Figure 7:
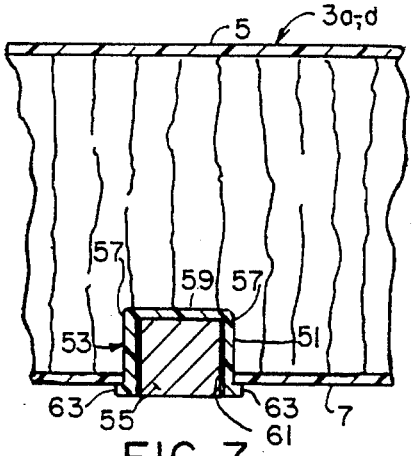
FIG. 7 is a cross-sectional view taken along line 7—7 of FIGS. 1E, 2D, 3E, and 4D.
Figure 8:
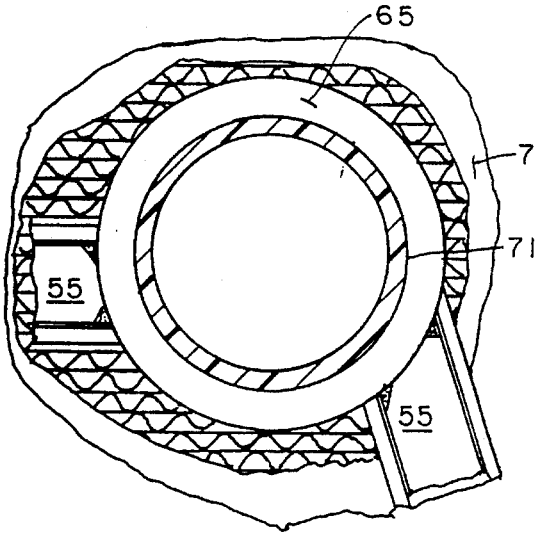
FIG. 8 is a cross-sectional view, partly broken away, taken along line 8—8 of FIGS. 1F, 2C, 3D, and 4C.
Figure 6:
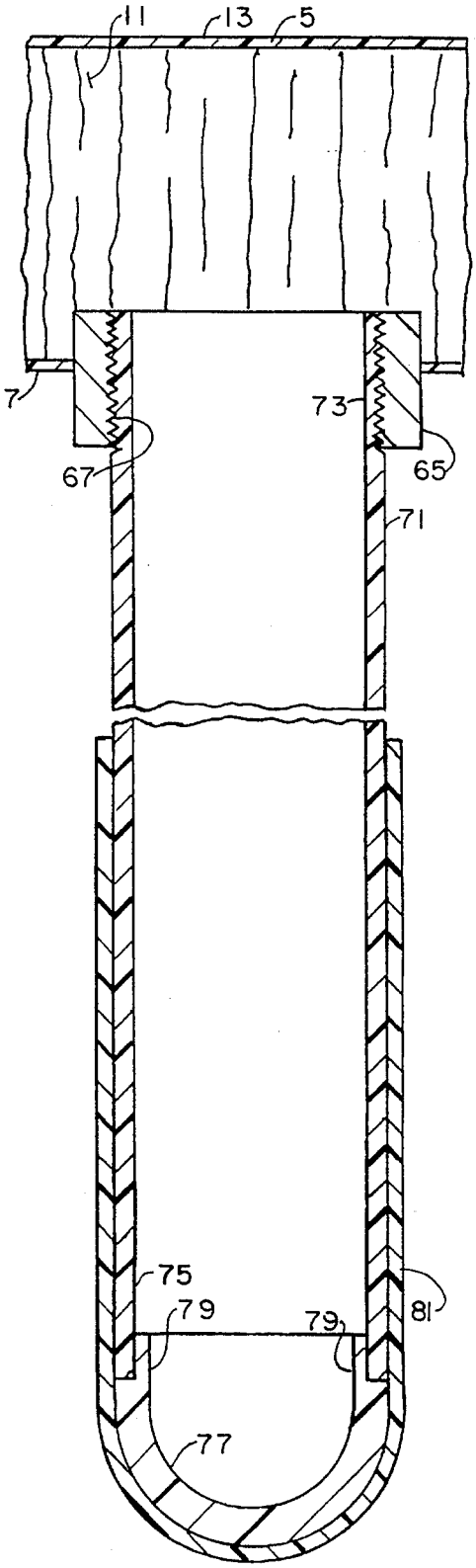
FIG. 6 is a cross-sectional view taken along line 6—6 of FIGS. 1B, 2C, 3D, and 4C.

Turning to FIG. 7, a groove 51 is formed in the bottom surface 7 of the tables. Groove 51 receives a channel 53 which, in turn, receives a reinforcing bar 55 of a framework support. Channel 53 has walls 57 and a base 59 defining a space 61 in which bar 55 is received. Flanges 63 extend from the walls over the bottom surface of the tables. Channel 53 is provided to prevent the bar 55 from damaging the medium 11, but yet provides reinforcement therefor.

As seen in the various FIGS. 1E, 2D, 3E, or 4D, the bars 55 are placed in the table surface in such a manner as to be near as much of the periphery of the table as possible. In tables 1*b–d*, bars 55 form rectangles. In table 1*a*, the bars 55 form a truncate and inverted V, as noted. The bars 55 are joined at corners 63. Bosses 65 are placed at the corners 63 and secured to the bars 55, as by welding, as noted. Bars 55 may either butt against bosses 65, as shown in the FIGS., or extend around a portion of the bosses. Bosses 65 are internally threaded as at 67, for reception of legs.

Legs 71 have upper, externally threaded sections 73 which are threadably received in the bosses and bottom ground engaging sections 75. The legs are preferably made of hollow metal or polymer tubes which have semispherical rubber feet 77 placed into or at the bottoms thereof. Rubber feet have walls 79 which extend inside of the leg tube to frictionally hold the feet to the tube. A cover 81 surrounds a lower portion of the legs. Cover 81 is made of rubber and is shaped complimentary to the shape of the leg and foot.

Figure 1A:
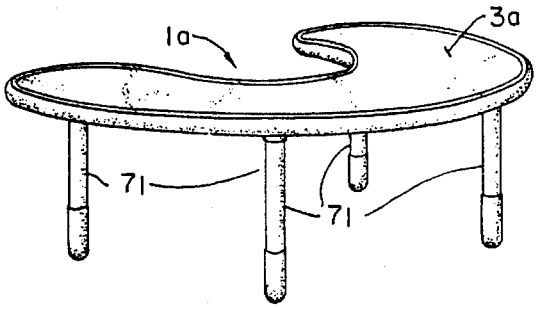
FIGS. 1A–1F are perspective, front elevational, top plan, back elevational, bottom plan, and side elevational views, respectively, of a curved table of the present invention.
Figure 1B:
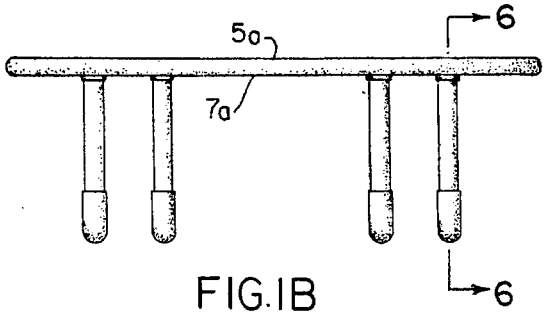
Figure 1C:
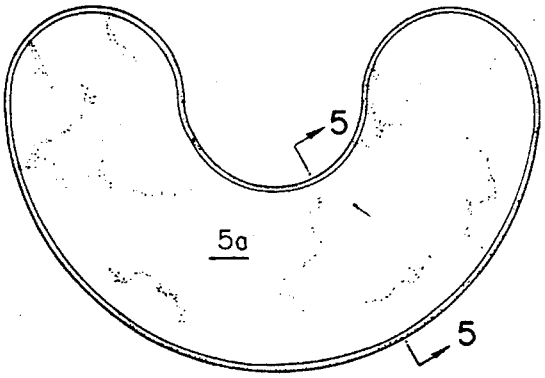
Figure 1D:
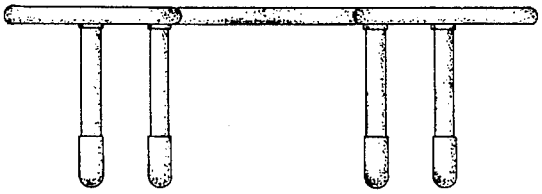
Figure 1E:
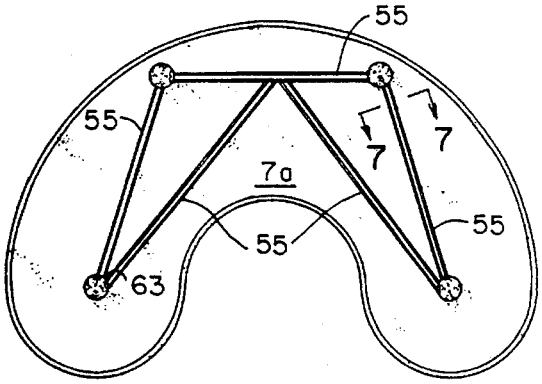
Figure 1F:
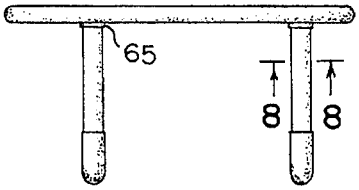
Figure 1G:
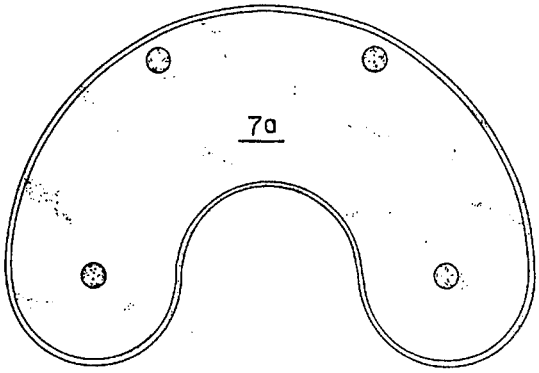
FIG. 1G shows an alternate construction for the underside of the table of FIG. 1.
Figure 2A:
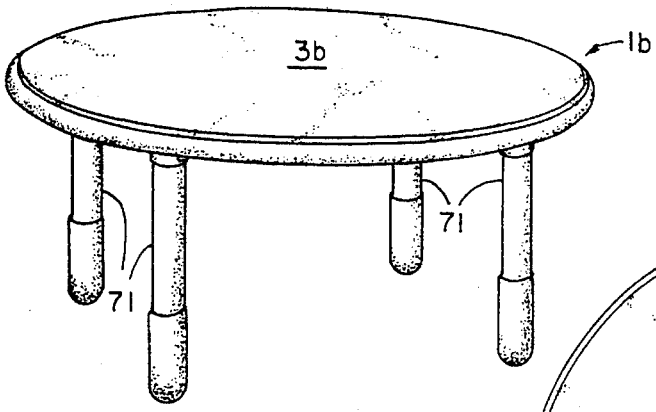
FIGS. 2A–2D are perspective, top plan, side elevational, and bottom plan views, respectively of a round table incorporating the present invention.
Figure 2B:
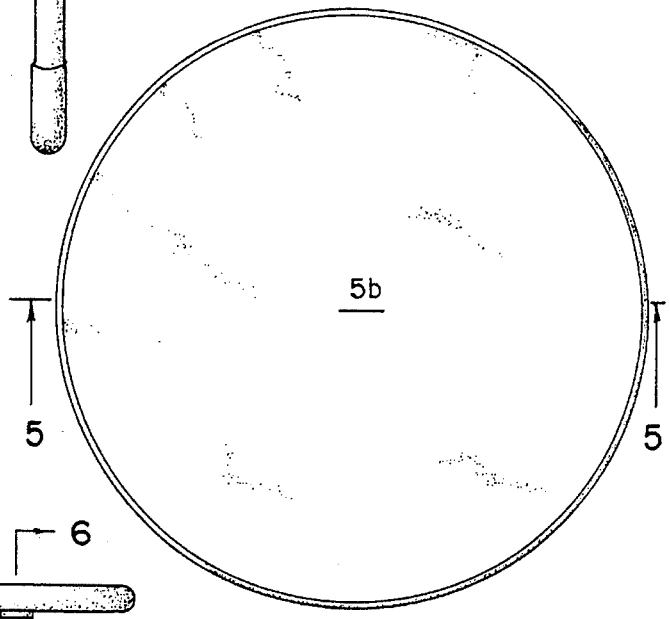
Figure 2C:
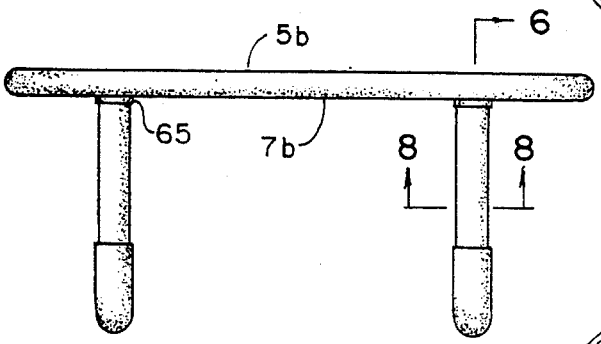
Figure 2D:
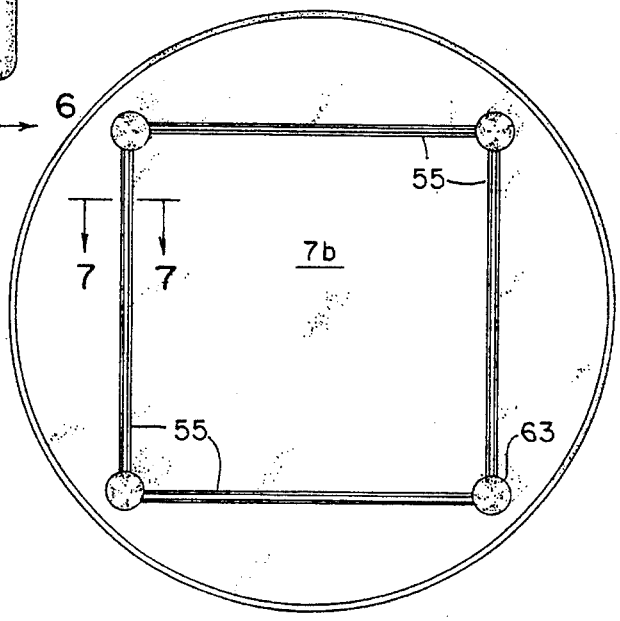
Figure 3A:
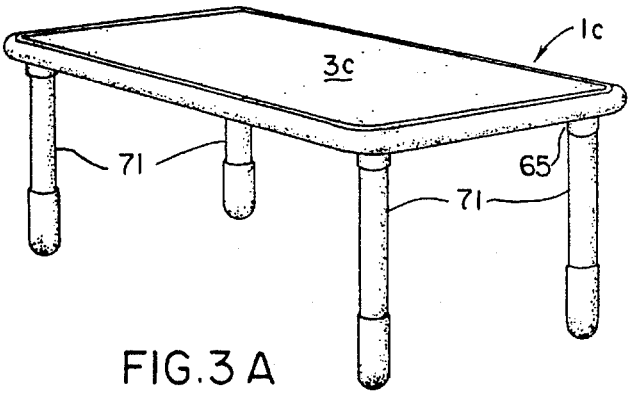
FIGS. 3A–3E are perspective, side elevational, top plan, front elevational, and bottom plan views, respectively, of a rectangular table incorporating the present invention.
Figure 3B:
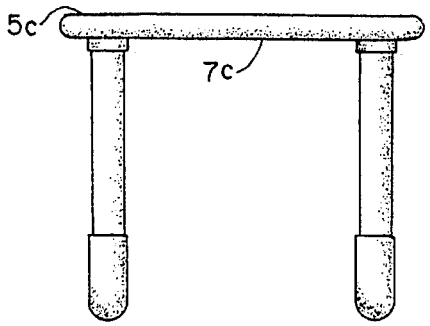
Figure 3C:
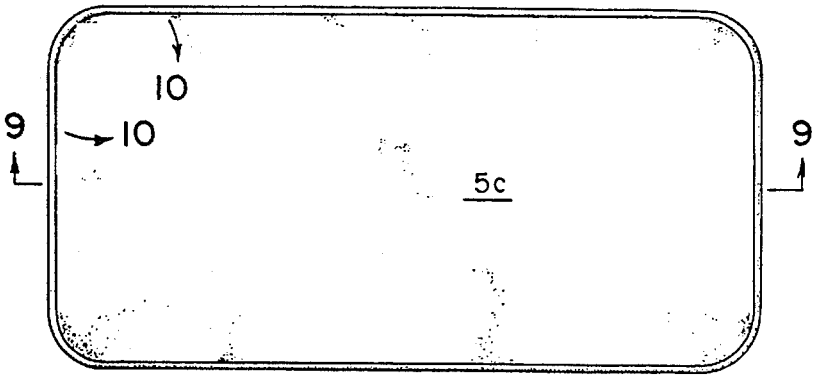
Figure 3D:
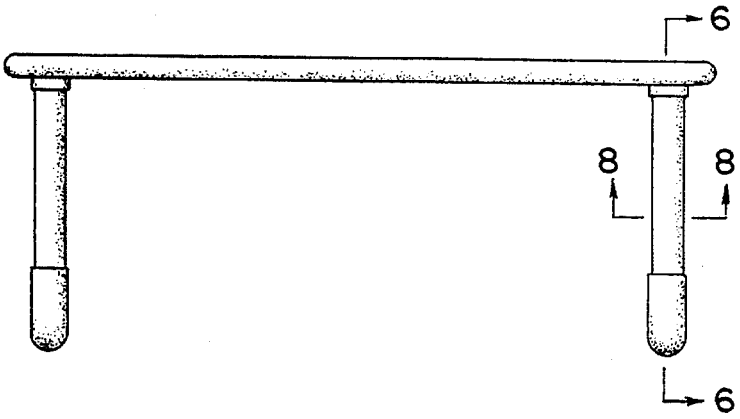
Figure 3E:
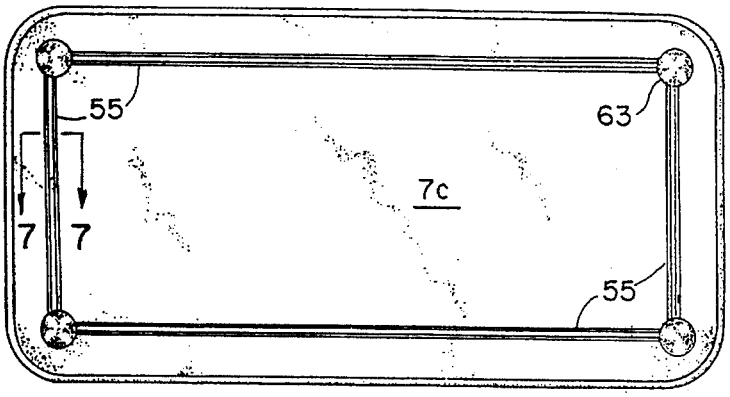
Figure 12:
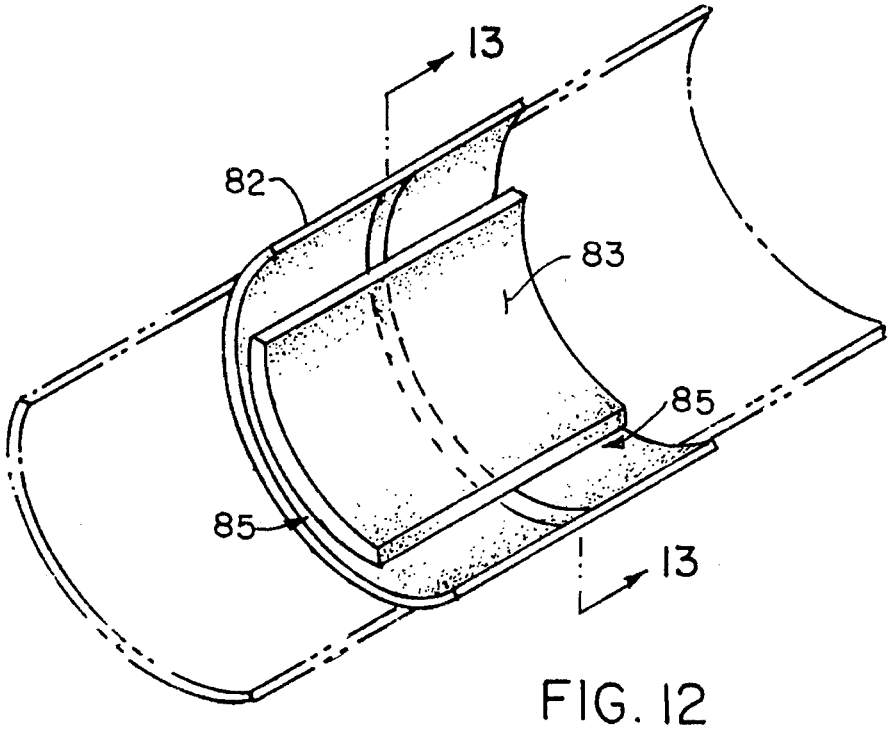
FIG. 12 is an isometric view of a modified form of connector for holding the ends of the peripheral cushioning and finishing piece as in,tailed around the periphery of a table.
Figure 13:
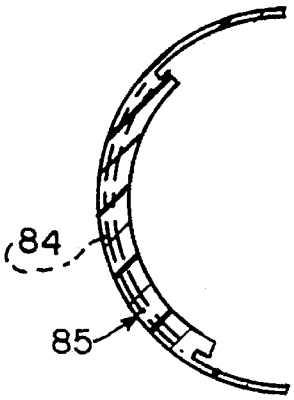
FIG. 13 is a sectional view taken along the line 13—13 of FIG. 12.
Figure 14:
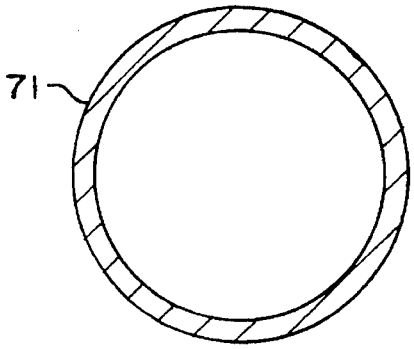
FIG. 14 is a sectional view of a metal leg, similar to the leg 71 disclosed in FIG. 8.

An alternative form of end connector for the style of finishing pieces as shown at 17 and 22 is disclosed is FIG. 12. In certain instances, where the flexible polymer material that forms the peripheral finishing pieces, that extend entirely around the peripheral edges of the table tops, is sufficiently flexible, then the finishing piece can be manipulated around the corners of the tables, particularly where the table may be fabricated into the arcuate shape, as shown in FIG. 1A, or in the round configuration, as shown in FIG. 2A. Furthermore, it is just as likely where the peripheral finishing piece has sufficient flexibility, in order to add cushioning to the lateral edges of the table top, then the finishing piece can be treated, such as by the application of some heat, curved around the corners of the tables, such as the rectangular and square tables as shown in FIGS. 3A and 4A. Hence, the finishing piece may be continuous around the entire perimeter of the structured table tops. In that case, an alternative form of end connector, such as that shown in FIG. 12, may be employed. Only one connector need be utilized, and that is at the two adjacent ends of the finished piece, after it has been inserted, glued in place, and arranged entirely around the perimeter of the table top. The connector includes an outer semicircular portion 82, that is generally slightly larger in diameter than the curved head section 19, or the head portion 29, of the shown finishing pieces in FIGS. 5 and 9. Integrally formed inwardly of the curved portion 82 is a second arcuate portion 83, and which is spaced slightly greater than the thickness of the head portions 19 and 29, by means of an integral spacer component 84. Hence, the two ends of the peripheral finishing piece, after it has been inserted entirely around the perimeter of the table, then have their head portions, either 19 or 29, as shown, inserted into the spacing 85 formed between the curved portions 82 and 83, and tightly slid into contact against the spacer 84, glued in place, and thereby provide a reasonably smooth finish for the ends of the flexible and cushioning type peripheral finishing component, necessitating the use of only a single connector, such as 82, for tightly securing the ends of the finishing piece together. FIG. 13 discloses the thickness of the spacer 84, so as to provide a reasonable spacer opening 85, into which the head portions 19 or 29 may insert, when finishing the ends of the resilient cushioning finishing pieces, when inserted, and installed, around the perimeter of a structured table.

As can be appreciated, the tables of the present invention are simple to put together. The tables are shipped with the reinforcing bars and finishing members already secured to the table top. The table top is completely assembled including their installed peripheral cushioning finishing piece. The legs are separate from the table top. All that need be done is screw the legs into the bosses.

This provides for a lightweight table which is sturdy and easy to assembly. Variations within the scope of the appended claims will be apparent to those skilled in the art. The foregoing disclosure is thus set forth for illustrative purposes only.

Having thus described the invention what is claimed and desired to be secured by Letters Patent is:

1. A table including:

a table top including a core having upper and lower surfaces, said upper and lower surfaces being covered with a liner, said liner extending beyond edges of said core to define a channel;

said core comprises one of corrugated paperboard, honeycombed paperboard, expanded foam, or expanded resin;

a finishing piece received in said channel, said finishing piece having a cushioned external surface, said finishing piece includes an elongate member having a foot section having legs received in said edge channel and a head section extending outwardly from said channel, said head section forming a generally shaped external surface of said finishing piece;

a groove formed in said table top lower surface;

reinforcing members received in said table lower disposed groove, said members defining corners;

a boss secured to said reinforcing members at each of said corners, said bosses having connecting surfaces the connecting surface of each boss having a threaded surface; and legs, said legs having an externally threaded upper portion which is connected to said bosses, the upper portion of each leg being threaded for connection to said bosses.

2. The table of claim 1 wherein said finishing piece is resilient to add cushioning around the periphery of the table top to which it secures.

3. The table of claim 1 wherein said elongate member includes a wall separating said head section from said foot section and a web extending between ends of said finishing member legs to define a generally hollow member.

4. The table of claim 3 wherein said finishing piece includes a corner member received at curved corners of said table, said curved corner member including a head section and legs being received in said channel, said head section being generally arcuate and extending outwardly from said channel.

5. The table of claim 4 wherein said curved and elongate finishing members interfit with each other; said curved finishing member having a lip at an end of its legs, said lip being received in said elongate finishing member.

6. A table including:

a table top including a core having upper and lower surfaces, said upper and lower surfaces being covered with a liner, said liner extending beyond edges of said core to define a channel;

7. A table including:

a table top including a core having upper and lower surfaces, said upper and lower surfaces being covered with a liner, said liner extending beyond edges of said core to define a channel;

a finishing piece received in said channel, said finishing piece having a cushioned external surface;

a groove formed in said table top lower surface;

reinforcing members received in said table lower disposed groove, said members defining corners;

a boss secured to said reinforcing members at each of said corners, and said bosses having connecting surfaces;

legs, said legs having a threaded upper portion which is connected to said bosses; and a connector, said connector being formed of a pair of arcuate members, spaced apart a distance so as to provide a spacing therebetween, and said connector cooperating with the ends of the finishing piece to provide a connection within the connector of the ends of the finishing piece together after its attachment within the channel of the table top.

8. The table of claim 7 and wherein the arcuate members of the connector having a radius substantially equivalent to the outer portion of the finishing piece for a table top.

9. A table including:

a table top including a core having upper and lower surfaces, said upper and lower surfaces being covered with a liner, said liner being linear and extending a short distance beyond the edges of said core to define a channel;

a finishing piece received in said channel, said finishing piece having a cushioned external surface;

a groove formed in said table top lower surface;

reinforcing members received in said table lower disposed groove, said members defining corners;

said reinforcing members include reinforcing bars;

a boss secured to said reinforcing members at each of said corners, said bosses having connecting surfaces, said reinforcing bars are connected to the surface of said bosses;

said reinforcing members and bosses being continuous in their extension as received in said table lower disposed groove upon the lower surface of said table top; and legs, said legs having a threaded upper portion which is connected to said bosses.

10. The table of claim 9 wherein said reinforcing bar corners define a radius, said radius surrounding said bosses, said bosses being secured in said radius.

11. The table of claim 9 wherein said legs comprise generally hollow tubes.

12. The table of claim 11 wherein said hollow tubes are metal.

13. The table of claim 11 wherein said hollow tubes are polymer.

14. The table of claim 11 wherein a foot piece is received in said leg at a bottom thereof, said foot piece having a rounded ground engaging portion and an annular lip which is received within said leg.

15. A table including:

a table top having a core providing upper and lower surfaces, said upper and lower surfaces being covered with a liner, said liner extending beyond the edges of said core to form said table top;

a finishing piece connecting to the edges of said core and liners, said finishing piece having an outer surface to form the periphery of said table top;

a reinforcing member connecting to the underside of said table top, said reinforcing member being continuous in its extension around the underside of said table top and being integrally formed and being at least one of flush or embedded in its connection to the underside of said table top, said reinforcing member having corners;

a boss secured to said reinforcing member at each of said corners, said bosses having connecting surfaces; and legs, said legs having fastening means provided at the upper ends for connection with said reinforcing member bosses to provide support for the table top above the floor.

16. The table of claim 15 wherein said core comprises corrugated paperboard, honey-combed paperboard, expanded foam, or expanded resin.

* * * * *

UNITED STATES PATENT AND TRADEMARK OFFICE

CERTIFICATE OF CORRECTION

PATENT NO. : 5,483,904

DATED : January 16, 1996.

INVENTOR(S) : Ray G. Kelly, et al.

It is certified that error appears in the above-identified patent and that said Letters Patent is hereby corrected as shown below:

Column 6, claim 6, line 12, after "channel;" insert:

---a finishing piece received in said channel, said finishing piece having a cushioned external surface.

a groove formed in said table top lower surface;

reinforcing members received in said table lower disposed groove, said members defining corners;

a boss secured to said reinforcing members at each of said corners, said bosses having connecting surfaces;

legs, said legs having an externally threaded upper portion which is connected to said bosses, said legs comprise generally hollow tubes, a foot piece is received in each of said legs at a bottom thereof, said foot piece having a rounded ground engaging portion and an annular lip which is received within said leg, and a leg covering, said leg covering enclosing said leg foot piece and at least a lower portion of said leg.---.

Signed and Sealed this

Ninth Day of July, 1996

*Attest:*

Bruce Lehman

BRUCE LEHMAN

*Attesting Officer*

*Commissioner of Patents and Trademarks*